United States Patent [19]

Varga et al.

[11] Patent Number: 4,700,538

[45] Date of Patent: Oct. 20, 1987

[54] METHOD AND APPARATUS FOR HANDLING A SLIVER

[75] Inventors: Andre Varga, Toronto, Canada; Henry Cripps, Stockport, England

[73] Assignee: Carding Specialists Ltd, Toronto, Canada

[21] Appl. No.: 766,034

[22] Filed: Aug. 15, 1985

[30] Foreign Application Priority Data

Aug. 17, 1984 [GB] United Kingdom ..... 8421020

[51] Int. Cl.[4] ..... D01G 23/08; D01H 5/28; D01H 7/92; D01H 11/00

[52] U.S. Cl. ..... 57/90; 19/150; 19/159 R; 19/243; 57/304; 57/315; 57/327; 57/328; 57/333; 57/350

[58] Field of Search ..... 57/328, 305, 315, 333, 57/350, 327, 90, 304; 19/236, 243, 150, 157, 159 R

[56] References Cited

U.S. PATENT DOCUMENTS

| | | | |
|---|---|---|---|
| 984,195 | 2/1911 | Cooper | 19/150 |
| 1,079,837 | 11/1913 | Casablancas | 57/328 |
| 1,771,656 | 7/1930 | Roe | 57/328 |
| 2,775,858 | 1/1957 | Kruse | 57/328 X |
| 2,778,186 | 1/1957 | Luttgren et al. | 57/327 |
| 3,130,535 | 4/1964 | Royster | 57/327 |
| 4,005,566 | 2/1977 | Hawkins | 57/90 X |
| 4,112,658 | 9/1978 | Morihashi | 57/328 |
| 4,329,840 | 5/1982 | Gasser et al. | 57/333 X |
| 4,372,010 | 2/1983 | Gauvain | 19/159 R |
| 4,399,648 | 8/1983 | Kato | 57/328 X |
| 4,497,167 | 2/1985 | Nakahara et al. | 57/333 X |

*Primary Examiner*—John Petrakes

*Attorney, Agent, or Firm*—Henry Sternberg; Bert J. Lewen

[57] ABSTRACT

Textile slivers tend to loose their cohesion when travelling over long distances from one piece of storage or processing equipment to another such piece of equipment. This problem is overcome by subjecting the sliver to a false twisting process during its travel, desirably by a pneumatic false twister located immediately adjacent to the sliver-receiving equipment.

11 Claims, 8 Drawing Figures

METHOD AND APPARATUS FOR HANDLING A SLIVER

This invention relates to the handling of slivers of natural or synthetic fibres or combinations of such fibres. The term sliver as used herein is to be construed as covering not only slivers formed from staple lengths of natural or cut man-made fibres but also to stretch-broken tow, that is a continuous filament synthetic fibre that has been broken to staple length and formed into a sliver-like bundle. Thus the term sliver is to be taken as meaning a bundle of staple length fibres wherein all the fibres are directed predominantly lengthwise of the bundle. It is well known that slivers as above defined have little tensile strength since all the fibres are predominantly parallel and there is thus little intertwining to give cohesion to the bundle.

As an example, in carding engines which process staple fibres of cotton and synthetic materials the web produced is conventionally condensed into one or more slivers. If the web is taken from the doffer in full width then a single sliver is formed, but alternatively the web can be split on the doffer to give a number of bands which are each individually condensed into slivers. Slivers leaving the carding engine usually pass between a pair of smooth-surfaced calender rollers which compress the sliver to give it sufficient cohesion to enable it to be passed to a coiler for deposit into a can or some other receptacle. Rather than store the sliver it can in some processes be passed directly from the calender rollers to subsequent processing apparatus, for example to an open-end spinner, to a knitting machine in the manufacture of simulated fur fabrics or to any lengthwise compacting apparatus in the manufacture of surgical dressings. In any one of these cases it is usual for the sliver to travel a substantial distance from the calender rollers of the carding engine to the coiler or respective manufacturing equipment.

There are other processes wherein it is necessary for a sliver to traverse a considerable distance, for example in the feeding of a drawframe creel when slivers are taken from several different cans in order to be blended and drafted for subsequent processing. This extended path of travel is also experienced in feeding drawn slivers by way of a gantry creel to the rotors of open-end spinning apparatus.

It can happen that if slivers are fed over large distances the fibres may tend to lose their cohesion and slide apart at some stage of their travel. This is increasingly becoming a problem with the need for finer slivers for open-end spinning, friction spinning, hollow spindle spinning and other processes. With the improved autolevelling facilities now available, slivers are usually drafted, resulting in a higher degree of fibre parallelism and so causing the sliver to have even less cohesion than was previously the case.

According to the present invention, a method of handling a sliver comprises taking the sliver from storage or processing equipment for the sliver, moving the sliver over a distance, which may be considerable, into the control of subsequent storage or processing equipment and subjecting the sliver to a false twisting process during its travel.

By imparting a false twist into the sliver during its travel the strength of the assembly of fibres as it passes along its path of travel is increased and the sliver is thus better able to withstand any forces which tend to draw individual fibres of the sliver apart from each other.

False twist is of course extensively used in the handling and in the texturising of mono-filaments and of multi-filament yarns or spun yarns but there has been no proposal for imparting false twist to sliver to improve its cohesion and strength during transport of the sliver. This handling technique for slivers is seen as being of great practical importance for the efficiency of further processing operations.

The false twist may be introduced into the sliver by many of the false twist devices that are readily available. Many such devices rely on frictional engagement with a rotating element but use of false twisters of this type may not be advantageous to implement the invention. One alternative form of false twister which is preferred is one which relies on pneumatic pressure by directing an air blast to form a vortex through which the sliver passes and by which the sliver becomes false twisted. Apart from the simplicity of this unit, the pneumatic action may exhaust fine dust and very short fibre from the sliver and thus may improve cleanliness of the sliver.

The level of twist imparted to the sliver is not critical as any twist will enhance the cohesion in comparison with a completely untwisted sliver. Twist factors in the range of 0.1 to 5 may conveniently be used, and from 0.5 to 4 may prove to be a particularly suitable range. The false twist can be imparted to the sliver immediately adjacent to the storage or subsequent processing apparatus. In this way the twist can be driven back through substantially the full length of the sliver to the first mentioned storage as processing equipment. The sliver will usually leave such equipment through means exerting compressive force on the sliver Those means may be a pair of rollers, for example calender rollers or autoleveller delivery rollers, may be a belt delivery system, for example from a card, or may be any web consolidation device of a card or other equipment. Alternatively, false twist can be imparted at some other processing stage or location of sliver passage. In general, it may be applied to drive twist back between any two points between which an increase in the cohesion in the band of fibres forming the sliver is required.

Any guides over which the sliver passes in its path should be of a form which will not present high resistance to the transmission of the false twist in the sliver from one side of the guide to the other. The more guides there are in the path and the higher their resistance to the passage of twist, the greater will be the twist level required to ensure that some false twist is present in the sliver over the whole of its path. In some cases it may be preferable to utilise more than one false twist device, each adjacent to an element that offers resistance to false twist and providing false twist to the sliver from that guide to the next upstream element that offers resistance to false twist. The invention includes within its scope many embodiments, some of which will now be described by way of example only, with reference to the accompanying drawings in which:

Figure 1:
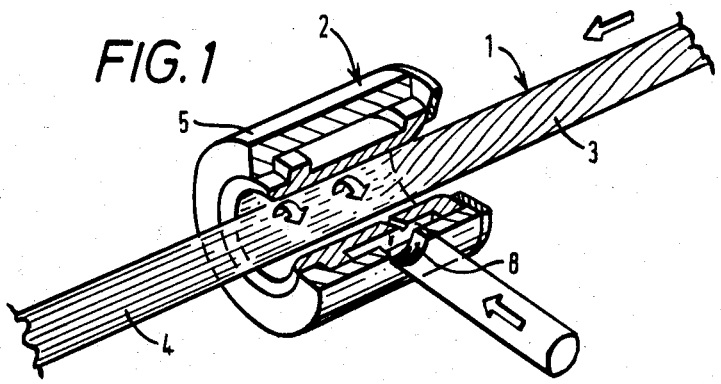
FIG. 1 is a schematic view of a sliver passing through a false twist device.
Figure 2:
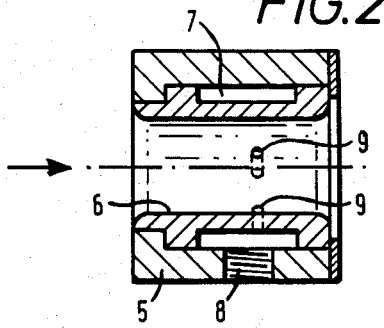
FIGS. 2 and 3 are respectively axial and radial sections through the device of FIG. 1.
Figure 3:
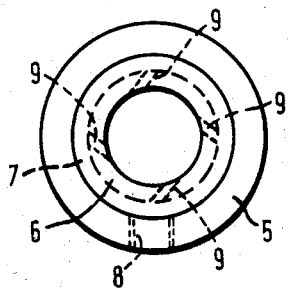

Referring now to FIG. 1 a sliver 1 is shown travelling through a pneumatic false twisting device 2. The device introduces twist into the upstream section 3 of the travelling sliver while it leaves the downstream section 4 substantially untwisted. It will thus be seen that the upstream section of the sliver has greater strength and cohesion due to the introduction of the twist.

The false twist device shown is illustrative of a number of such devices that could be used in the method of the invention. The device comprises a jacket 5 within which is mounted a sleeve 6, the jacket and sleeve being shaped so that a plenum chamber 7 is formed between them. A port 8 to which a compressed air line may be connected extends through the jacket 5 to the interior of the plenum chamber. The sleeve 6 is formed with a plurality of passages 9 leading from the plenum chamber to the interior of the sleeve, the passages each being inclined at an acute angle to the axis of the sleeve and directed oppositely to the direction of movement of sliver through the device. The passages 9 are also each inclined at an angle to the radial plane so that air introduced into the sleeve will have a swirling motion around the axis of the sleeve. It is this swirling motion that imparts the false twisting action to the sliver.

It is not necessary that there be a plurality of passages 9, and in some embodiments a single passage may be adequate. Any passage or passages need not be inclined oppositely to the direction of travel of sliver through the device, but may be perpendicular to that direction or inclined in the direction of travel.

The basic advantage given by the false twist device in improving sliver cohesion has already been discussed. Generally, such improved cohesion will be temporary, as no twist will be present in the sliver downstream of the false twist device. Under some circumstances, however, the false twist device may permanently affect sliver cohesion by felting together a few of the surface fibres prior to being packaged or whilst in transit to a machine for further processing. This can be achieved by operating a pneumatic false twister at a higher than normal air pressure procuding a very highly twisted sliver temporarily and a faintly fasciated structure permanently. This is a useful and advantageous property to give a carded sliver especially if it is composed of short or regenerated fibres or if the creel of the subsequent process is unduly long.

In addition to improving cohesion a pneumatic false twist device may also be used to reduce the amount of, or eliminate, water or other solvents which may be within or on the surface of a sliver. For example, in the production of felted yarns an assembly of wool or other fibres is soaked in hot water and subjected to a felting action by rubbing aprons; after these operations have been repeated several times the fibres are sufficiently felted to produce a cohesive sliver and must be dried before passing to the next process. The yarn will usually contain about 300% of water which is conventionally driven off by means of a microwave oven. A pneumatic false twist device may be used to perform part or whole of this drying process; the excess surface water may be removed more efficiently by the twister and the final stages of drying accomplished by a microwave device; alternatively the complete drying operation may be achieved by a false twist device fed with normal or hot compressed air or by a series of such devices.

Figure 4:
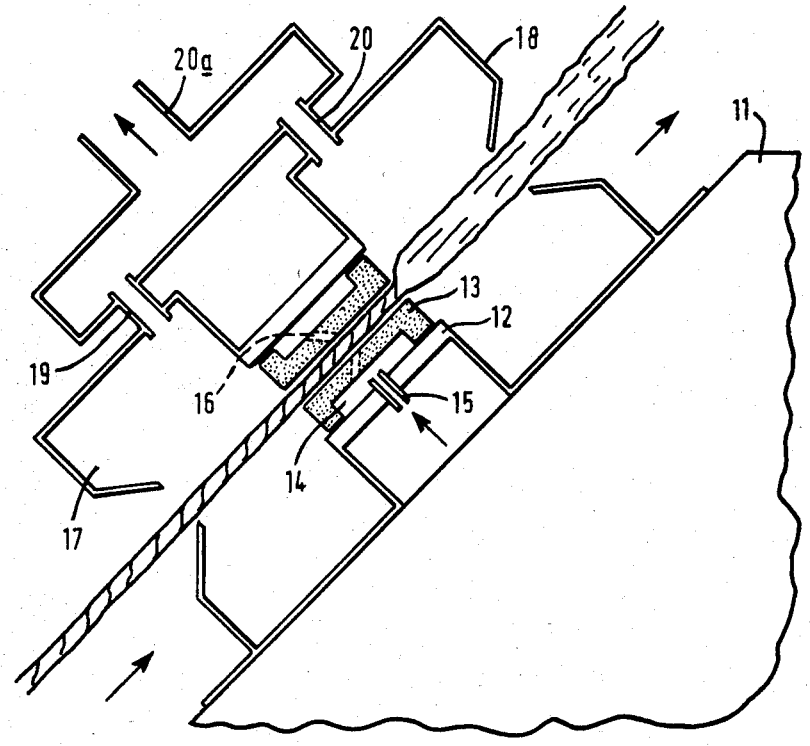
FIG. 4 is an axial cross-section through a second embodiment of false twist device mounted on a coiler head.

As will have been appreciated, a false twist device may be provided at any suitable point along the path of travel of a sliver. It may be a separately supported unit or may be integrated with or incorporated into a sliver storing or processing unit. FIG. 4 shows an alternative embodiment of false twist device mounted on the head 11 of a coiler for receiving a sliver and depositing it in coiled form in a can or other receptacle. As in the embodiment of FIG. 1 the false twist device comprises a jacket 12 and inner sleeve 13 between which a plenum chamber 14 is formed, the chamber being fed with compressed air through a connector 15. Inclined air passages 16 are formed through the sleeve to induce a swirling effect that causes false twisting of the sliver upstream of the device. The jacket supports walls 17 and 18 defining upstream and downstream annular chambers through which the sliver passes immediately before and immediately after passing throughthe sleeve. Vacuum extraction ducts 19, 20 are associated with the chambers and lead to an extraction system 20*a* to which a source of vacuum may be connected. The effect of the air stream within the sleeve is not only to create false twist but also to loosen and throw clear from the sliver part of any microdust or any short fibre that may be carried by the sliver. The waste removed in this cleaning operation is not allowed to escape into the atmosphere, since the release occurs within the chambers and the waste is thus carried away by the vacuum extraction unit to an appropriate discharge system.

The sliver leaving the false twisting device is led to the usual guide on the top of the coiler head and then through an opening in the coiler head to the sliver depositing mechanism.

An integrated pneumatic false twisting device shown in FIG. 4 may have the compressed air flow thereto controlled by means of a monitoring device which is responsive to the speed of the shaft of the coiler mechanism, so that the rate of induction and twist is proportional to the sliver delivery rate. If the pneumatic false twisting device is replaced by a mechanical falst twisting device then it may be driven from any one of the revolving shafts of the coiler mechanism, so that again the twist induction will vary in accordance with the rate of delivery of the sliver.

In a manner analogous to that shown in FIG. 4 a false twisting device may be incorporated into any piece of sliver processing equipment and driven or monitored therefrom in a manner similar to that outlined above. For example, a false twister could be used to enhance sliver strength and so assist slivers in the creels of drawframes, speedframes, open-end spinners, knitting machines making fur fabrics and the like. In the case of either processing equipment or storing equipment such as a coiler it will be evident that the false twisting device may be a separate unit mounted adjacent to the processing or storing apparatus.

If a sliver is to travel considerable distances then it may be convenient, depending upon the character of the sliver, to insert a false twist at two or more points along its path. One insertion point would then desirably be as close as possible to the storing or subsequent processing apparatus and that device would impart a twist which would run upstream to the preceding false twisting device. That preceding device would in turn insert a false twist which would run upstream along the sliver path either to a further false twister or to the pressure rollers of the carding engine or other location from which the sliver is drawn.

Figure 5:
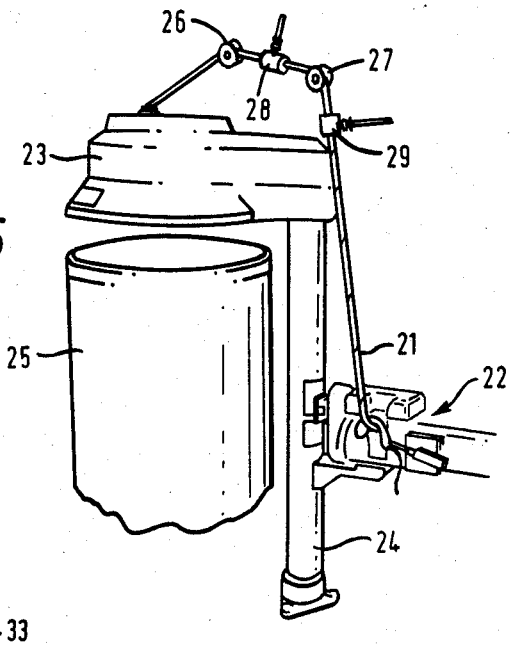
FIGS. 5 and 6 are layout diagrams showing two alternative methods by way of which a sliver may be fed to a coiler.

For example, FIG. 5 shows a sliver 21 being delivered from the knock-off device 22 of a card to the head 23 of a coiler, the head being mounted on a stand 24. From the coiler head sliver is deposited in coiled form in a can 25. Sliver guides 26 and 27 are associated with the coiler and false twisting devices 28, 29 are associated one with each of the guides. By positioning the device 28 immediately adjacent to the guide 26 it is located as close as practical to the entry point of the sliver into the coiler head. Twist is induced upstream of the device 28, but the guide 27 prevents a barrier to the passage of that twist, or at least materially reduces the amount of twist that may pass. Accordingly, the incorporation of the second false twist device 29 immediately upstream of the guide 27 ensures that twist is present in the sliver as it passes from the knock-off device 22 to the false twister 29. Although a knock-off device 22 has been shown it will be appreciated that the sliver need not be delivered from this, but that it may be taken from any card belt delivery device, calender roller device, or autolevelling device.

Figure 6:
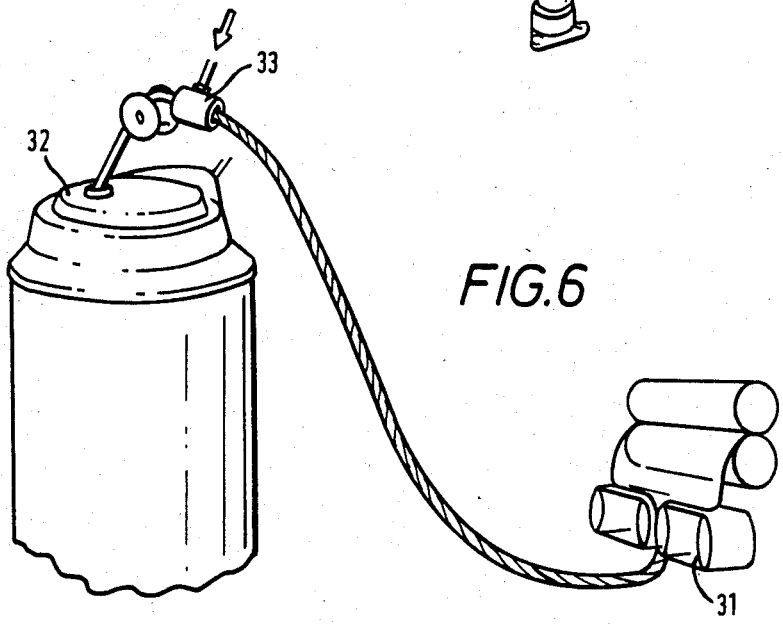

Once the web of a card has been consolidated into a sliver a false twister can be employed and exploited. As shown in FIG. 6, it is possible therefore to eliminate any or all of the devices which may be situated between a card belt delivery system 31 and the coiler 32 if so desired. For example, where the false twister 33 forms part of, or is attached or adjacent to, the coiler head it is possible to by-pass or omit all the aforementioned devices; the false twist tensions the sliver and gives it sufficient strength to enable it to be transported satisfactorily between the delivery belt system and coiler.

Figure 7:
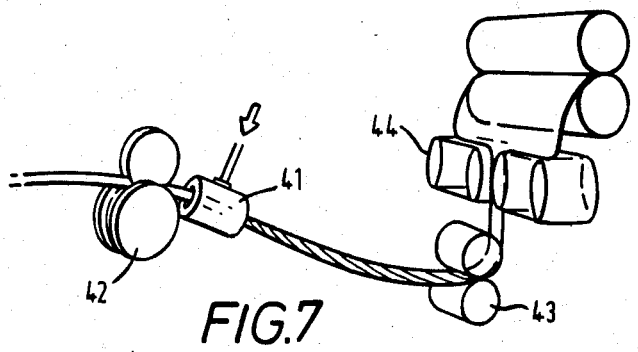
FIG. 7 is a diagrammatic view of the feeding of a sliver in a further embodiment.

It is possible to carry out a sliver autolevelling function incorporating a false twist unit. This would be especially beneficial where a sliver is to be, for example, direct open-end spun. In its simplest form the autoleveller would comprise a false twist unit and means for applying a small positive draft of, say 1.2, to the sliver. In one embodiment of the invention, shown in FIG. 7, the false twist unit 41 would be situated immediately preceding the normal calender rollers 42 and the autolevelling action would occur between the calender rollers 42 and the calender rollers 43 at the downstream end of a belt delivery unit 44. Because of the tension draft, the sliver would be subjected to a process of drafting against false twist. The false twist will distribute itself between the false twister unit and the calender rollers 43; there will be more than average twist in the thinnest regions (making them relatively difficult to draft) and less than average twist in the thickest regions (making these relatively easy to draft). As the thicker places are drafted the false twist redistributes itself. The result is a more uniform sliver. The same autolevelling action could of course be arranged to take place between a coiler trumpet and calender rollers. A more sophisticated system could be designed whereby the sliver thickness is monitored, for example by replacing calender rollers 42 by a thickness measuring arrangement, and used to control the draft.

Reference has also been made to the fact that the air blast used to introduce the false twist may also perform a cleaning function on the sliver.

Figure 8:
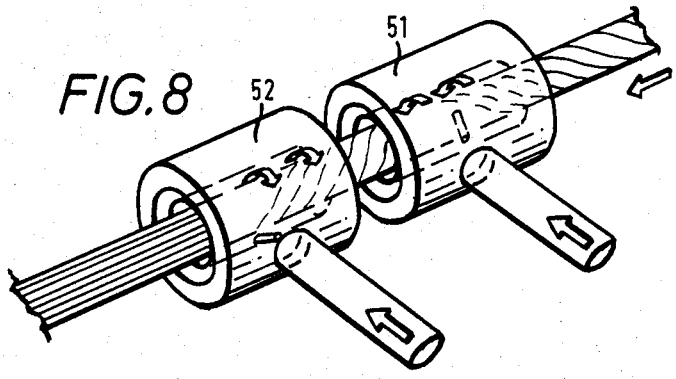
FIG. 8 illustrates passage of a sliver through two adjacent false twisting devices.

Conditions can be created by purposeful design of the device or devices which will increase the cleaning effect of the air blast. For example, the blast of air may be intermittent or more than one false twisting device 51, 52 may be used in opposition to each other as shown in FIG. 8; such an arrangement would of course be equipped with dust hoods to convey the contaminated air to waste. The effect of the opposed air streams is to cause opposite directions of twist to occur in the fibres as indicated in FIG. 8. In the device 51 there is a region where the two twist zones meet and thus a region of substantially zero twist. The injection of a strong blast of air at this point encourages the removal of dust, short fibres, neps and other waste from the fibres, the waste being conveyed to an appropriate discharge system. Very effective cleaning may be effected in this way, and particularly high levels of microdust removal may be noted.

It will be appreciated that the examples described hereinbefore are only illustrative and that the invention is applicable in a wide range of sliver handling environments.

We claim:

1. A method of handling a silver, comprising continuously applying mechanical tension to the sliver for taking the sliver from a first piece of sliver storage or processing equipment and for causing the sliver to travel a substantial distance into the control of a spaced second piece of sliver storage or processing equipment, and continuously directing a stream of gas toward the silver intermediate the first and second pieces of equipment for continuously pneumatically forming a false twist in the sliver for increasing the strength and cohesion of the sliver during its travel between the first and second pieces of equipment by effecting a temporary increase of interfiber friction in the sliver and for simultaneously removing impurities from the sliver, without said stream of gas contributing substantially to movement of the sliver in longitudinal direction.

2. A method according to claim 1, in which at least one of said pieces of equipment comprises storage equipment.

3. A method according to claim 1, in which the false twist is imparted to the sliver by passing the sliver through a vortex formed in a false twister device by supplying air under pressure to said device.

4. A method according to claim 1, in which twist is imparted to the sliver at a twist factor in the range of from 0.1 to 5.

5. A method according to claim 1, in which the twist is imparted to the sliver immediately adjacent to said second piece of equipment.

6. A method according to claim 1, in which false twist is imparted to the sliver in at least two locations between said first piece of equipment and said second piece of equipment.

7. Apparatus for handling a sliver, comprising a first piece of sliver storage or processing equipment, a second piece of sliver storage or processing equipment spaced a substantial distance from said first piece of equipment, means defining a path of travel for said sliver between said first and second pieces of equipment, means for continuously applying mechanical tension to the silver to cause it to travel along said path and means for temporarily increasing the strength and cohesion of the sliver during its travel between the first and second pieces of equipment, said means comprising a false twister device arranged along said path of travel for continuously subjecting the sliver to a false twisting process in order to effect a temporary increase of interfiber friction in the sliver, said false twister device comprising pneumatic means for supplying a gas under pressure to the sliver for imparting a temporary twist to the sliver and for simultaneously cleaning the sliver without contributing substantially to movement of the sliver in longitudinal direction.

8. Apparatus according to claim 7, including means for exerting compressive force on the sliver as it leaves said first piece of equipment.

9. Apparatus according to claim 7, in which said false twister device is located immediately adjacent to said second piece of equipment.

10. Apparatus according to claim 9, in which said false twister device is mounted on said second piece of equipment.

11. Apparatus according to claim 7, in which said false twister device comprises a sleeve through which the sliver is directed, at least one passage through the sleeve wall inclined at an angle to a radial plane through the sleeve, and means for supplying air under pressure to the passage.

* * * * *